US010279965B2

(12) United States Patent
Enghard

(10) Patent No.: US 10,279,965 B2
(45) Date of Patent: May 7, 2019

(54) LID COMPRISING DRINKING CLOSURE FOR A DRINKING VESSEL

(71) Applicant: Florian Enghard, Frankfurt am Main (DE)

(72) Inventor: Florian Enghard, Frankfurt am Main (DE)

( * ) Notice: Subject to any disclaimer, the term of this patent is extended or adjusted under 35 U.S.C. 154(b) by 172 days.

(21) Appl. No.: 14/917,793

(22) PCT Filed: Sep. 10, 2014

(86) PCT No.: PCT/EP2014/002439
§ 371 (c)(1),
(2) Date: Nov. 21, 2016

(87) PCT Pub. No.: WO2015/036113
PCT Pub. Date: Mar. 19, 2015

(65) Prior Publication Data

US 2017/0158384 A1 Jun. 8, 2017

(30) Foreign Application Priority Data

Sep. 12, 2013 (DE) ..... 10 2013 014 042
Sep. 20, 2013 (DE) ..... 10 2013 015 823

(51) Int. Cl.
*B65D 47/08* (2006.01)
*A45F 3/16* (2006.01)
(Continued)

(52) U.S. Cl.
CPC ..... *B65D 47/08* (2013.01); *A45F 3/16* (2013.01); *A47G 19/2205* (2013.01);
(Continued)

(58) Field of Classification Search
CPC .... B65D 47/0804; B65D 47/08; B65D 47/06; B65D 25/40; B65D 83/28; B65D 55/16;
(Continued)

(56) References Cited

U.S. PATENT DOCUMENTS 651,460 A * 6/1900 Higgins ..... A23G 3/50 215/236
1,013,393 A * 1/1912 Hull ..... A23G 3/50 215/236

(Continued)

*Primary Examiner* — Anthony Stashick
*Assistant Examiner* — Onekki Jolly
(74) *Attorney, Agent, or Firm* — Michael W. Ferrell; Ferrells, PLLC; Anna L. Kinney

(57) ABSTRACT

The invention relates to a lid with drinking closure (5) for a drinking vessel (15) that includes an upwardly curved cover element (1), which internally comprises a screw thread (16) for connection with the drinking vessel (15) and comprises a drinking opening (2) with an upwardly oriented round drinking spout (6), whereby a hinge (3) is arranged on the upper cover surface (14) of the cover element (1) and is connected with a pivot arm (7) with a closure cap (8), and which closes the drinking spout (6) in a form-fitting manner upon downward pivoting. The invention is characterized in that the drinking opening (2) with the drinking spout (6) is arranged laterally offset relative to a straight line (11) through the hinge center (13) and the center point (12) of the cover element (1), and in that the pivot arm (7) is laterally bent or curved from the hinge (3) to the drinking spout (6).

8 Claims, 3 Drawing Sheets

Figure 1:
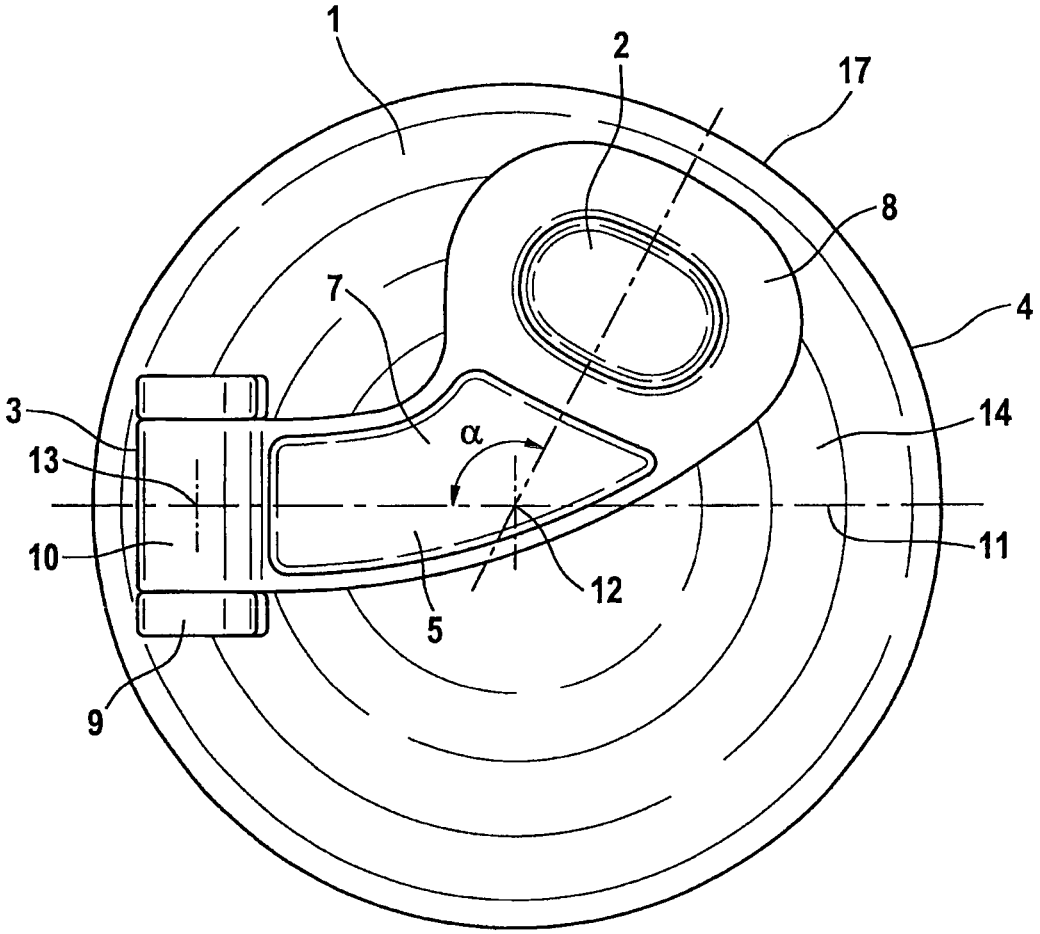

(51) Int. Cl.
*A47G 19/22* (2006.01)
*B65D 43/16* (2006.01)

(52) U.S. Cl.
CPC ..... *B65D 43/16* (2013.01); *B65D 47/0871* (2013.01); *B65D 47/0895* (2013.01)

(58) Field of Classification Search
CPC ..... B65D 43/16; B65D 43/169; B65D 2543/00046; B65D 2251/0018; B65D 2251/0006; B65D 2251/0003; B65D 2251/0021; B65D 2251/0025; B65D 2251/1058; B65D 2251/1008; B65D 2251/1016; B65D 2251/105; A47G 19/2205; A47G 19/2266; A47G 19/2272
USPC ..... 220/254.3, 254.1, 715, 714, 713, 711, 220/254.4, 259.1, 256.1, 831, 832, 833, 220/834, 835; 215/243, 237, 235; 222/568, 567, 566
See application file for complete search history.

(56) References Cited

U.S. PATENT DOCUMENTS

D552,929 S * 10/2007 de Groote ..... D7/300.1
D580,227 S * 11/2008 Roth ..... D7/392.1
D597,365 S * 8/2009 Oas ..... D7/300.1
D632,918 S * 2/2011 Gordon ..... D7/300.1
D646,919 S * 10/2011 Nilsson ..... B65D 47/148 D7/300.1
D655,131 S * 3/2012 Nilsson ..... B65D 47/148 D7/392.1
D687,661 S * 8/2013 Cetera ..... D7/300.1
D699,996 S * 2/2014 De Leo ..... D7/300.1
D748,478 S * 2/2016 Sorensen ..... D9/443
D751,344 S * 3/2016 Charlton ..... D7/300.1
D752,390 S * 3/2016 Ksiazek ..... D7/300.1
D780,516 S * 3/2017 Cornelius ..... D7/510
D805,827 S * 12/2017 Toth ..... D7/300.1
2003/0102313 A1* 6/2003 Weber ..... B65D 51/007 220/254.4
2007/0029325 A1* 2/2007 Herold ..... B65D 23/00 220/288
2011/0220674 A1* 9/2011 Honeyghan ..... A47G 19/22 220/849
2011/0253733 A1* 10/2011 Meyers ..... B65D 47/089 220/833
2012/0061398 A1* 3/2012 Nilsson ..... A47J 43/27 220/568
2014/0360908 A1* 12/2014 Sorensen ..... B65D 21/0228 206/501

* cited by examiner

LID COMPRISING DRINKING CLOSURE FOR A DRINKING VESSEL

The invention relates to a lid with a drinking closure for a drinking vessel according to the preamble of patent claim 1.

A number of drinking vessels and drinking bottles exist, which are provided with a lid for mobile use. In many cases the lid is equipped so that it simultaneously has a drinking spout, which is often also closeable.

From the DE 92 08 97 U1, there is known a closure for a drinking bottle, as it is mounted on bicycles. This closure is embodied like a cylinder-shaped lid, which has on its bottom rim an internal thread that is screwable onto an external thread of the drinking bottle. An elevated drinking spout, in which a central drinking opening is provided, is attached or mounted in the center of this lid. A drinking tube is inserted into the drinking opening, and the head thereof lies in contact on the drinking opening. For closing the drinking opening and the drinking tube located therein, a straight linear pivot arm is provided, which is secured via a hinge on the rim of the lid. For closing the drinking opening, a semicircular closure cap is attached or mounted on the pivot arm, whereby upon pivoting, the closure cap seats onto the drinking opening and thereby closes the drinking opening. In order that the pivot arm remains in its closure position upon being pressed down, additionally a latch hook is attached or mounted on the pivot arm and engages into a latch housing and thereby locks or arrests the pivot arm. For drinking, the latch hook is released, and due to the spring the pivot arm pivots outwardly and uncovers the drinking opening. In that regard, for drinking, the drinking head with the drinking tube located thereon must be pulled out of the drinking opening, in order to suck the liquid out of the drinking vessel like with a drinking straw. After releasing the drinking tube, it slides back into the drinking vessel and the head lies in contact on the drinking opening so that the pivot arm can be pressed down in order to close the drinking opening and the drinking tube. Such a lid has the disadvantage that the drinking liquid can only be sucked out through a relatively thin drinking tube, which is unfavorable for many drinking liquids and requires a greater cleaning effort upon reuse. In that regard, the drinking tube also cannot simply be omitted, because the pivot arm can be pivoted only up to at most 180° to the lid upper part, so that in a direct drinking process the person would bump against the pivot arm with his or her nose.

Therefore, it is the object of the invention to improve a closure for a drinking bottle of the above mentioned type so that the drinking process is also possible without a drinking tube, and the drinking opening can be opened and again closed in a simple manner, and the drinking process is not hindered or impaired by a closure cap.

This object is achieved by the invention set forth in the patent claim 1. Further development and advantageous example embodiments of the invention are set forth in the dependent claims.

The invention has the advantage that the drinking process of a person is not hindered or impaired, due to the laterally bent or curved pivot arm and the drinking spout being arranged laterally offset relative to the hinge. Simultaneously, the hinge attached or mounted on the upper surface of the lid, with a relatively small pivoting range, enables a simple opening and closing of the drinking spout, without requiring a larger outer diameter of the lid, in order to be able to drink unhindered.

Figure 2:
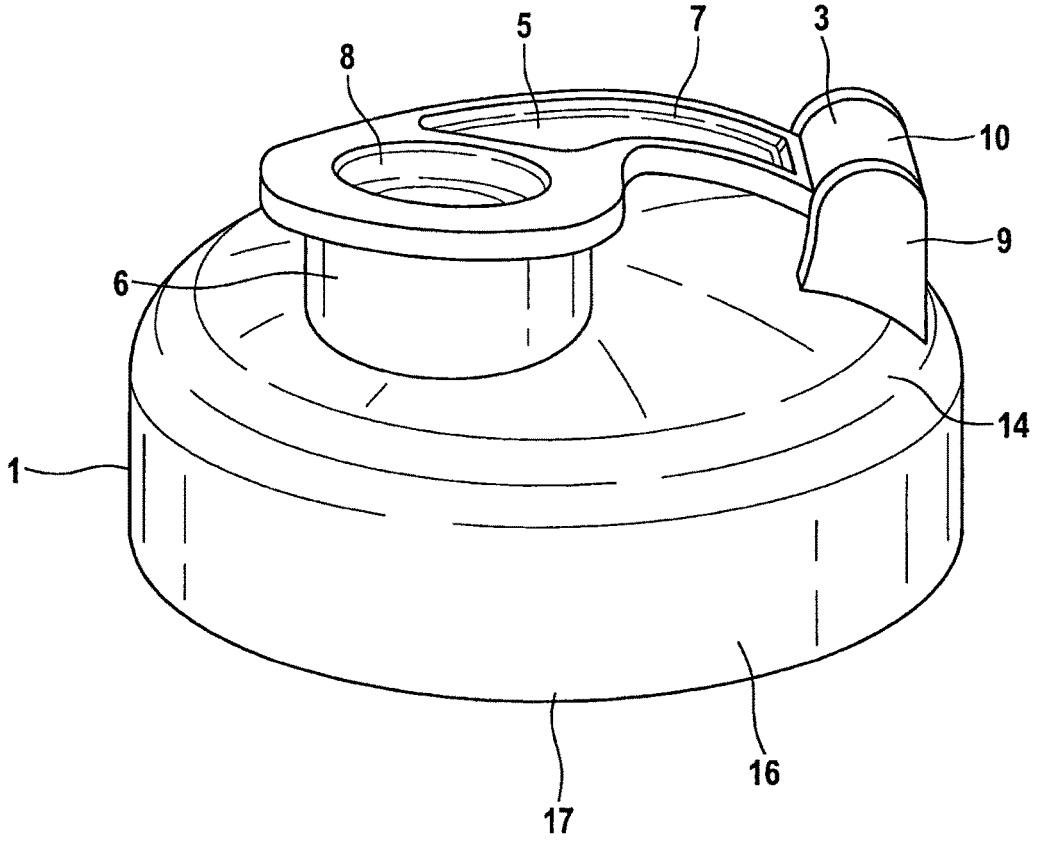

The invention will be explained in further detail in connection with an example embodiment, which is illustrated in the drawing. It is shown by:

FIG. 1: a top view onto a lid with a drinking closure;

FIG. 2: a perspective side view of the lid with drinking closure; and

Figure 3:
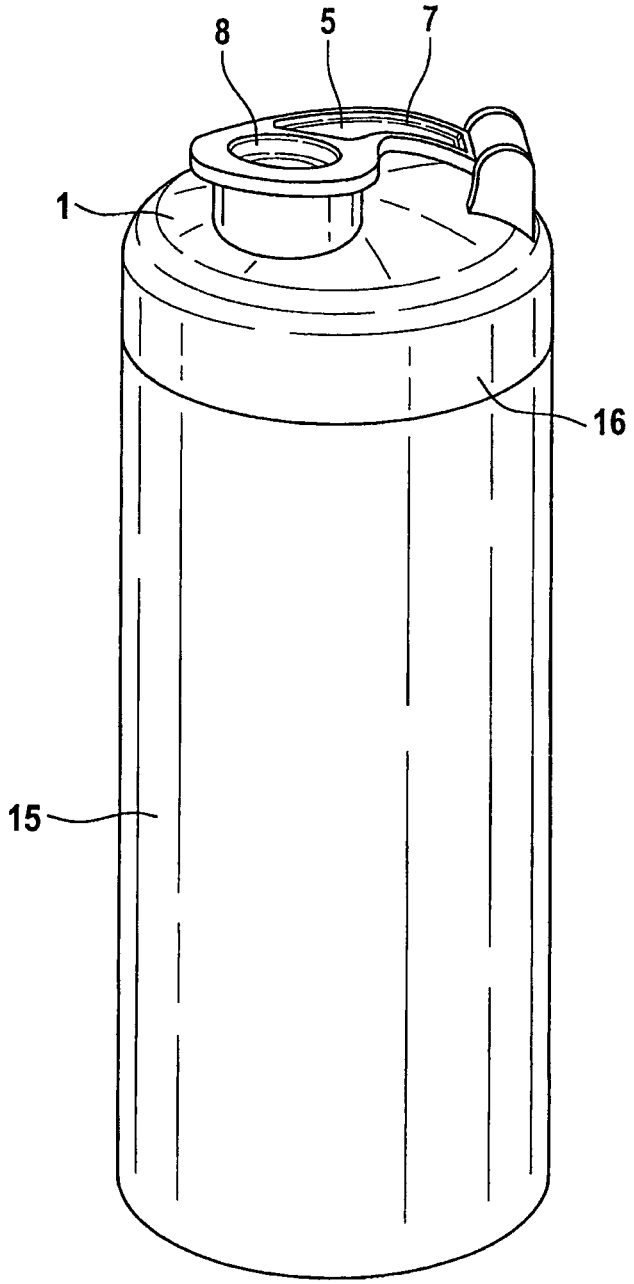

FIG. 3: a drinking bottle with screwed-on lid with drinking closure.

In FIG. 1, a lid with drinking closure for a drinking vessel is illustrated in a top plan view, which lid can be screwed onto a drinking bottle 15 as a drinking vessel, and comprises on its upper cover surface 14 a drinking opening 2 with an upwardly outwardly protruding drinking spout 6, which is closeable in a form-fitting manner by a closure cap 8, which is arranged on a laterally bending pivot arm 7, which is supported pivotably on a hinge 3 arranged on the upper cover surface 14.

The lid essentially consists of a circular cover element 1, of which the diameter corresponds to at least the outer diameter of the drinking bottle that is to be closed. In that regard, the cover element 1 is upwardly convexly arched or domed in the manner of a dome or cupola, and internally has a hollow space that is open toward the bottom, on the outer ring 4 or outer rim 17 of which an internal thread 16 is arranged, which is screwable onto an external thread of a drinking vessel 15. The upwardly directed convex curvature, on its upper cover surface 14, can be embodied round as well as cylindrical or in other shapes deviating therefrom. On this upper cover surface 14, outwardly from its center point 12, preferably in the edge or rim area, two hinge cheeks or end plates 9 are arranged, which are connected rigidly with the cover element 1. Furthermore, the cover element 1 includes, spaced apart from the hinge cheeks 9, a drinking opening 2, on which an upwardly oriented drinking spout 6 is arranged, which is embodied round, internally hollow, and rigidly connected with the drinking opening 2 in the cover element 1. In that regard, the drinking spout 6 is preferably embodied elliptical and slightly tapering upwardly, whereby the inner diameter of the drinking spout 6 amounts to preferably 15-30 mm and protrudes upwardly approximately 10-20 mm out of the cover element 1. The drinking spout 6 is preferably arranged close to the outer rim, whereby the larger or major semi-axes of the ellipse are oriented tangential to the outer rim 17. In that regard, the drinking opening 2 with its drinking spout 6 is laterally offset relative to a straight line 11 through the hinge center 12 and the center point 12 of the cover element 1. In that regard, the lateral offset can be offset toward the right side as well as also toward the left side relative to this straight line 11. In that regard, the lateral offset is preferably provided in an angle $\alpha$ from 90°-140°, so that with a pivoted-open pivot arm 7 during drinking, to the extent possible it does not appear as an interference. The cover element 1 is preferably embodied as a synthetic plastic injection molded part, and can therefore be produced easily and economically.

For closing the drinking bottle 15, above the cover element 1 the pivot arm 7 is provided with a closure cap 8, which are supported between the two hinge cheeks 9. In that regard, this drinking closure 5 consists of a hinge inner part 10, the pivot arm 7, and the closure cap 8 adjoining thereon, which are connected with one another to form a complete or total component. In that regard the hinge inner part 10 is embodied cylinder-shaped and is connected with an axle or two oppositely located protrusions with the hinge cheeks 9. The pivot arm 7 adjoining thereon is embodied as a flat synthetic plastic part and is laterally bent or curved, whereby the lateral bend or curve describes a bend or kink angle which corresponds to the lateral offset of the drinking opening 2 with the drinking spout 6. The closure cap 8 is arranged connected and adjoining thereon and spaced apart from the hinge 3, wherein the closure cap 8 on the top comprises a flat rim and inwardly includes a cupola-like or dome-like elliptical bulge or convexity, which is embodied form-fittingly to the drinking opening 2 of the upper area of the drinking spout 6. Thereby it is ensured that the closure cap 8, upon the downward pivoting of the pivot arm 7, can be guided exactly fittingly into the drinking opening 2 of the drinking spout 6 and tightly closes it. In that regard, the dome-shaped closure cap 8 in axial orientation is slightly expanded or widened toward the top, so that the connection is also lockable or arrestable in a frictional or force-engaging manner in the drinking opening 2, and nonetheless can easily be opened. In that regard the closure cap 8 can, however, also be embodied in such a manner so that it is tipped in a sealing manner from the outside over the drinking spout 6. Moreover, the hinge 3 can also consist of a stationary or fixed hinge inner part 10 that is connected with the cover element 1, and two hinge cheeks 9 that are connected with the pivot arm 7.

In FIG. 2 of the drawing, the lid is illustrated perspectively in a side view, which illustrates in further detail the laterally bending or kinking pivot arm 7 with the closure cap 8 locked or arrested in the drinking spout 6. From FIG. 2 of the drawing it can be seen that the drinking spout 6 comprises approximately the height of the hinge cheeks 9 and thus can be opened as well as closed with a pivoting process. In that regard the pivot arm 7 is pivotable by at least 180° relative to the drinking spout 6, because the hinge cheeks 9 are arranged close to the outer rim 17 or outer ring 4 of the cover element 1. On the other hand it is advantageous to arrange the drinking spout 6 also as close as possible to the outer rim 17 of the cover element 1 in order to be able to empty the drinking bottle 15 as completely as possible. In that regard the drinking bottle 15 must be lifted pivotally as vertical as possible, whereby due to the bending or kinking pivot arm 7, the nose of the drinking person will contact onto the upper cover surface 14 laterally next to the pivot arm 7, so that the drinking process is barely hindered or impaired by the pivot arm 7 with the closure cap 8.

In FIG. 3 of the drawing, the lid is screwed onto a drinking container which is embodied as a drinking bottle 15. In that regard, the drinking bottle 15 is preferably embodied cylindrical, and on the upper rim is provided with an external thread, onto which the internal thread 16 of the lid is screwable. Thereby, overall a compact drinking bottle 15 is achieved, of which the outer diameter essentially corresponds to the outer diameter of the drinking bottle 15, whereby the drinking closure 5 lies in close contact on the drinking opening 2 of the cover element 1 and thereby overall a compact drinking bottle 15 is achieved.

The invention claimed is:

1. Lid with drinking closure (5) for a drinking vessel (15) that includes an upwardly curved cover element (1), which internally comprises a screw thread (16) for connection with the drinking vessel (15) and comprises a drinking opening (2) with an upwardly oriented round drinking spout (6), whereby a hinge (3) is arranged on the upper cover surface (14) of the cover element (1) and is connected with a pivot arm (7) with a closure cap (8) which tightly closes the drinking spout (6) upon downward pivoting, characterized in that the drinking opening (2) with the drinking spout (6) is laterally offset toward the right side or toward the left side relative to a straight line (11) through the hinge center (13) by an angle supplementary to an angle $\alpha$ at the center point (12) of the cover element (1), and in that the pivot arm (7) is laterally bent or curved at angle $\alpha$ from the hinge (3) to the drinking spout (6), wherein $\alpha$ is an angle from 90° to 140°.

2. Lid according to claim 1, characterized in that the drinking spout (6) is laterally offset by an angle supplementary to angle $\alpha$.

3. Lid according to claim 1, characterized in that the drinking closure (5) consists of a hinge (3) with a pivot arm (7) and a closure cap (8) connected thereto, which is arranged pivotably with at least an angle of 180° above the cover element (1).

4. Lid according to claim 3, characterized in that the hinge (3) consists of two outer hinge cheeks (9), which are rigidly connected with the cover element (1), and a hinge inner part (10), which is rigidly connected with the pivot arm (7) and the closure cap (8).

5. Lid according to claim 1, characterized in that the closure cap (8) includes a downwardly oriented convex curvature, wherein an outer surface of the convex curvature is adapted to an inner surface of the drinking spout (6) such that the convex curvature and the drinking spout are frictionally engaged when the lid is closed.

6. Lid according to claim 1, characterized in that the drinking closure (5) is a one-piece synthetic plastic injection molded part.

7. Lid according to claim 1, characterized in that the cover element (1) has a circular diameter and an axial outer rim (17) or outer ring (4), and is embodied upwardly curved out, and inside comprises a hollow space that is open toward the bottom, whereby at least one hinge cheek (9) and an upwardly oriented drinking spout (6) is arranged on the upper cover surface (14) of the cover element (1) on the rim areas (17, 4) thereof, and the cover element is a one-piece synthetic plastic injection molded part.

8. Lid according to claim 1, that is a two-piece article and consists of a cover element (1) and a drinking closure (5).

* * * * *